US005457613A

United States Patent [19]

Vandenbelt et al.

[11] Patent Number: 5,457,613

[45] Date of Patent: Oct. 10, 1995

[54] PERIPHERALLY SEALED CARD-LIKE FLASHLIGHT DEVICE

[75] Inventors: Rudy Vandenbelt, Ottawa, Canada; Peter Altman, Austin, Tex.

[73] Assignee: Lumatec Industries, Inc., Austin, Tex.

[21] Appl. No.: 255,396

[22] Filed: Jun. 8, 1994

[51] Int. Cl.[6] ..... F21L 7/00

[52] U.S. Cl. ..... 362/200; 362/201; 362/205

[58] Field of Search ..... 362/205, 200, 362/201

[56] References Cited

U.S. PATENT DOCUMENTS

| | | | |
|---|---|---|---|
| 2,625,645 | 1/1953 | Crane | 362/116 |
| 2,699,192 | 1/1955 | Poutinen | 362/116 |
| 3,243,586 | 3/1966 | Fioravanti | 362/116 |
| 3,296,429 | 1/1967 | Schwartz | 362/116 |
| 3,310,668 | 3/1967 | Schwartz | 362/116 |
| 3,377,475 | 4/1968 | Frigon | 362/116 |
| 4,085,315 | 4/1978 | Wolter et al. | 362/116 |
| 4,122,510 | 10/1978 | Halliday, Jr. | 362/201 |
| 4,242,724 | 12/1980 | Stone | 362/205 |
| 4,250,539 | 2/1981 | Leitzel et al. | 362/200 |
| 4,368,507 | 1/1983 | Reynolds | 362/200 |
| 4,392,186 | 7/1983 | Cziment | 362/116 |
| 4,521,833 | 6/1985 | Wolter | 362/116 |
| 4,628,418 | 12/1986 | Chabria | 362/116 |
| 4,819,140 | 4/1989 | Griffin | 362/205 |
| 4,926,300 | 5/1990 | Ralston | 362/200 |

FOREIGN PATENT DOCUMENTS

| | | | |
|---|---|---|---|
| 1017139 | 1/1966 | United Kingdom | 362/200 |

*Primary Examiner*—Ira S. Lazarus
*Assistant Examiner*—L. Heyman
*Attorney, Agent, or Firm*—John R. Flanagan

[57] ABSTRACT

A peripherally sealed card-like flashlight device includes an inner light generating module, a middle folded card insert, and an outer peripherally sealed protective cover. The inner module includes a flat battery pack, a lamp having a light emitting element and a pair of conductive lead elements extending therefrom, and an electrical switch assembly attached on the flat battery pack. Strips of metallic tape are used to electrically connect one of the lead elements to one electrically conductive portion of the flat battery pack and to position the other of the lead elements over an aperture through the switch assembly and overlying and spaced from another electrically conductive portion of the flat battery pack. The switch assembly is operable for making and breaking an electrical circuit between the flat battery pack and lead elements of the lamp by applying and releasing pressure on and from a region of the outer protective cover overlying the aperture of the switch assembly of the inner light generating module.

20 Claims, 1 Drawing Sheet

10
12
14
14A
16
22
24
26
28
30
32
34
36
38
40
42
44
45
46
47
48
50
53
54
54A
54B
56
56A
2
3
6

PERIPHERALLY SEALED CARD-LIKE FLASHLIGHT DEVICE

TECHNICAL FIELD

The present invention generally relates to a miniature pocket flashlight and, more particularly, is concerned with a thin flat peripherally-sealed card-like flashlight device.

BACKGROUND ART

Miniature pocket flashlights which can be stored in a pocket or attached to a key chain are known in the prior art. An example of a miniature pocket flashlight is the one disclosed in U.S. Pat. No. 4,628,418 to Chabria. The Chabria miniature pocket flashlight has a hollow flexible outer case open at opposite ends, a pair of end caps closing the opposite ends of the outer case, a battery receptacle and electrical switch unit disposed in the case which is activated by squeezing the flexible case, and a lamp electrically connected and mounted to the unit and protruding through a hole in one of the end caps on the case (or alternatively the lamp is mounted to a socket in the end cap itself). At least the one end cap is removable in order to replace the lamp and batteries.

The design of the Chabria flashlight embodies at least three major drawbacks. First, the design permits light generated by the lamp to disperse in all possible radial directions from the lamp thus reducing the amount of light projected by the lamp on any one desired location. Second, the design requires that the lamp extend through a hole or from a socket in the end cap of the case. This design requirement leaves the lamp unprotected, exposing it to frequent impacts with extraneous objects while the flashlight is being handled and carried by the user. Such impacts are likely to soon cause breakage of the lamp filament and result in malfunction and premature shortening of the useful life of the lamp. Third, the design requires that one or both of the end caps of the case be frictionally fitted to the ends of the case so as to be readily removable to replace the lamp and batteries. Over time such frictional fit tend to loosen up and allow the parts of the flashlight to come apart. This increases the risk of losing an end cap which would then require the replacement of the flashlight itself.

In view of the aforementioned drawbacks of the pocket flashlight design of the above-cited Chabria patent, it is readily apparent that a need still remains for a more functional and reliable miniature pocket flashlight design.

DISCLOSURE OF THE INVENTION

The present invention provides a thin card-like flashlight device designed to satisfy the aforementioned needs in which all components are enclosed and covered by a relatively flat peripherally sealed outer cover. The sealed thin card-like flashlight device of the present invention comprises: (a) an inner light generating module having a pair of opposite faces and means for generating light; (b) a middle card insert extending over and substantially overlying said opposite faces of inner module; and (c) an outer protective cover having a periphery hermetically sealed about and encasing the middle insert and the inner module. The inner module includes a flat battery pack, a lamp having a light emitting element and a pair of conductive lead elements extending therefrom, and an electrical switch assembly attached on the flat battery pack. Strips of metallic tape are used to electrically connect one of the lead elements to one electrically conductive portion of the flat battery pack and to position the other of the lead elements over an aperture through the switch assembly and overlying and spaced from another electrically conductive portion of the flat battery pack. The switch assembly is operable for making and breaking an electrical circuit between the flat battery pack and lead elements of the lamp by applying and releasing pressure on and from a region of the outer protective cover overlying the aperture of the switch assembly.

With such enhanced construction, the flashlight device of the present invention provides a package which is relatively thin and flat, has a card-like appearance and handles and feels similar to a credit card with which users are already familiar. The flashlight device provides a highly fashionable item as well as providing the lighting function.

Also, due to the hermetically sealed construction of the thin card-like flashlight device, it is waterproof, its durability and reliability are greatly enhanced, and its useful life is greatly extended. Also, its cost of manufacture is relatively low such that the flashlight device is sufficiently economical as to make replacement of lamp and batteries unnecessary.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which.

BEST MODE FOR CARRYING OUT THE INVENTION

Figures 1, 2, 3, 4, 5, 6:
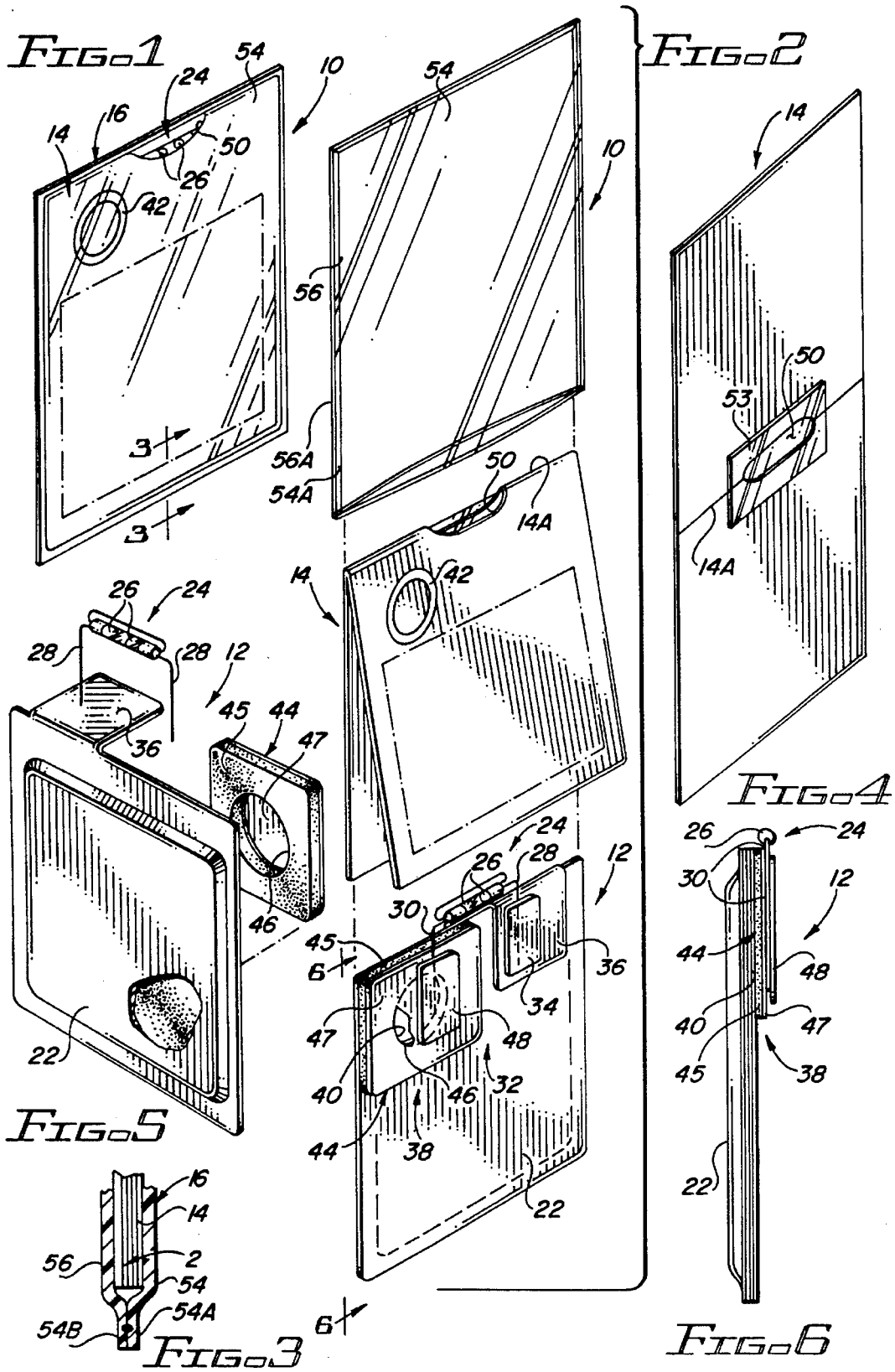
FIG. 1 is a perspective view of a thin card-like flashlight device of the present invention.
FIG. 2 is an exploded perspective view of the flashlight device of FIG. 1, showing an outer protective cover, an inner light generating module, and a middle folded card insert.
FIG. 3 is an enlarged fragmentary sectional view of the flashlight device taken along line 3—3 of FIG. 1.
FIG. 4 is a perspective view of the middle card insert in unfolded condition.
FIG. 5 is an exploded perspective view of the inner light generating module of the device.
FIG. 6 is an enlarged side elevational view of the inner light generating module as seen along line 6—6 of FIG. 2.

Referring to the drawings and particularly to FIGS. 1 and 2, there is illustrated a flat thin card-like flashlight device, generally designated 10, of the present invention. Basically, the flashlight device 10 includes an inner light generating module 12, a middle folded card insert 14 overlying the inner module 12, and an outer sleeve-like protective cover 16 peripherally and hermetically sealed about and encasing the middle insert 14 and inner module 12.

Referring to FIGS. 2, 5 and 6, the inner light generating module 12 of the device 10 has a pair of opposite upper and lower faces 18, 20 and includes a flat battery pack 22, a lamp 24 having a light element 26 and a pair of conductive lead elements 28, 30 extending therefrom, and means 32 for electrically coupling the lead elements 28, 30 of the lamp 24 to the flat battery pack 22. As one example, the flat battery pack 22 may take the form of a battery pack commercially-available from Polaroid Corporation.

Referring still to FIGS. 2, 5 and 6, the electrical coupling means 32 of the inner module 12 of the device 10 preferably includes a first electrically conductive member 34 applied on a first electrically conductive portion 36 of the flat battery pack 22 so as to overlie one of the lead elements 28 of the lamp 24 placed on the flat battery pack 22 and retain the one lead element 28 against and in electrical contact with the first electrically conductive portion 36 of flat battery pack 22. The coupling means 32 also includes a switch assembly 38 attached to a second electrically conductive portion 40 of the flat battery pack 22 being spaced from the first electrically conductive portion 36 thereof. The switch assembly 38 is operable for making and breaking an electrical circuit between the flat battery pack 22 and the lead elements 28, 30 of the lamp 24 by applying and releasing finger pressure on a region of the outer protective cover 16, such as marked by a circle 42, overlying the switch assembly 38.

More particularly, the switch assembly 38 includes a switch pad 44 attached about and over the second electrically conductive portion 40 of the flat battery pack 22. The switch pad 44 is a thin annular body 45 of electrically non-conductive foam material defining a central aperture 46 therethrough and having a pair of opposite faces 48, 50 with an adhesive coating thereon and, a conductive switch plate 51, such as fabricated of brass, being applied over the one adhesively-coated face 50 of the annular body of foam material. The annular switch pad body 44 is adhesively attached on the other of its faces 48 to the flat battery pack 22 such that the aperture 46 defined through the switch pad 44 encompasses the second electrically conductive portion 40 of the flat battery pack 22. The switch assembly 38 also includes a second electrically conductive member 48 overlying and electrically connected with the other of the lead elements 30 of the lamp 24. The second conductive member 48 and switch plate 44 support the other lead element 40 across the aperture 46 of the switch pad body 45 and spaced from the second electrically conductive portion 48 of the flat battery pack 22 encompassed by the aperture 46. As examples, the first and second electrically conductive members 34, 48 can be strips of electrically conductive metallic tape having an adhesive coating on one side thereof for adhering the strips of metallic tape respective to surface portions of the flat battery pack 22 and the switch pad 44.

In view of the above description, it can be readily understood that the first and second conductive members 34, 36, the first and second electrically conductive portions 36, 40 of the flat battery pack 22 and the two lead elements 28, 30 of the lamp 24 will form a completed electrical circuit between the flat battery pack 22 and the lamp 24 whenever the other lead element 30 is brought into contact with the second electrically conductive portion 40 of the flat battery pack 22 surrounded by the aperture 46 of the switch pad 44. Also, it can be readily understood that the switch assembly 38 is thus operable for making and breaking the electrical circuit between the flat battery pack 22 and the lead elements 28, 30 of the lamp 24 merely by applying and releasing finger pressure on and from the circled region 42 of the outer protective cover 16 which overlies the aperture 46 of the switch assembly 38.

Referring to FIGS. 2 and 4, the middle card insert 14 of the device 10 is flat sheet of flexible paper or plastic material folded in half about a middle transverse fold line 14A which, in the folded condition, can extend over and substantially overlie and cover the opposite upper and lower faces 18, 20 of the inner module 12. Also, the insert 14 has an opening 50, preferably of oblong configuration, formed therein along the middle fold line 14A so as to define an aperture 50 aligned with the light element 26 of the lamp 24 of the inner light generating module 12. One or both exterior faces 52 of the middle card insert 14 can be imprinted with a media displaying information to a user of the device 10. Also, preferably, the opening 50 formed in the folded card 14 is reinforced by application of a creased strip of plastic film 53, such as mylar, which is bonded to the inside surface of the insert 14 about the opening 50.

Referring to FIGS. 1–3, the outer flat sleeve-like protective cover 16 is a pair of upper and lower flat sheets 54, 56 of transparent plastic material being hermetically sealed to one another about aligned continuous peripheral edges 54A, 56A thereof. Thus, the outer protective cover 16 has a sleeve-like flat configuration. The aligned peripheral edges 54A, 56A can be sealed together by any suitable process, one example being by ultrasonic energy.

It is thought that the present invention and its advantages will be understood from the foregoing description and it will be apparent that various changes may be made thereto without departing from its spirit and scope of the invention or sacrificing all of its material advantages, the form hereinbefore described being merely preferred or exemplary embodiment thereof.

We claim:

1. A sealed card-like flashlight device, comprising:

(a) an inner light generating module having a pair of opposite faces and means for generating light;

(b) a middle card insert extending over and substantially overlying said opposite faces of said inner light generating module; and (c) an outer protective cover formed of a pair of flat planar sheets of plastic material aligned with one another at and sealably connected to one another about continuous peripheral regions thereof so as to provide said pair of sheets of said outer protective cover in a generally flat sleeve-like configuration completely surrounding and hermetically sealing and encasing said middle insert and said inner light generating module therein.

2. The device of claim 1 wherein said inner light generating module includes:

a flat battery pack; and a lamp having a light element and a pair of conductive lead elements extending therefrom; and means for electrically coupling said lead elements of said lamp to said flat battery pack.

3. The device of claim 2 wherein said means for electronically coupling includes a first electrically conductive member overlying and electrically connecting one of said lead elements to a first electrically conductive portion of said flat battery pack.

4. The device of claim 3 wherein said means for electronically coupling also includes a switch assembly attached to a second electrically conductive portion of said flat battery pack being spaced from said first electrically conductive portion thereof, said switch assembly being operable for making and breaking an electrical circuit between said flat battery pack and said lead elements of said lamp by applying and releasing pressure on and from a region of said outer protective cover overlying said switch assembly.

5. The device of claim 4 wherein said switch assembly includes:

an electrically non-conductive switch pad attached about said second electrically conductive portion of said flat battery pack, said switch pad having an aperture defined therethrough encompassing said second electrically conductive portion of said flat battery pack; and a second electrically conductive member overlying and electrically connected with the other of said lead elements and supporting said other lead element across said aperture of said switch pad and spaced from said second electrically conductive portion encompassed by said aperture.

6. A sealed card-like flashlight device, comprising:

(a) an inner light generating module having a pair of opposite faces and means for generating light;

(b) a middle card insert extending over and substantially overlying said opposite faces of said inner light generating module; and (c) an outer protective cover having a periphery sealed about and hermetically encasing said middle insert and said inner light generating module and being sealed;

(d) said inner light generating module including a flat battery pack, a lamp having a light element and a pair of conductive lead elements extending therefrom, and means for electrically coupling said lead elements of said lamp to said flat battery pack;

(e) said coupling means including a first electrically conductive member overlying and electrically connecting one of said lead elements to a first electrically conductive portion of said flat battery pack, said coupling means also including a switch assembly attached to a second electrically conductive portion of said flat battery pack being spaced from said first electrically conductive portion thereof, said switch assembly being operable for making and breaking an electrical circuit between said flat battery pack and said lead elements of said lamp by applying and releasing pressure on and from a region of said outer protective cover overlying said switch assembly;

(f) said switch assembly including an electrically non-conductive switch pad attached about said second electrically conductive portion of said flat battery pack, said switch pad having an aperture defined therethrough encompassing said second electrically conductive portion of said flat battery pack, said switch assembly also including a second electrically conductive member overlying and electrically connected with the other of said lead elements and supporting said other lead element across said aperture of said switch pad and spaced from said second electrically conductive portion encompassed by said aperture;

(g) said switch pad being a thin annular body of electrically non-conductive material defining said central aperture and having a pair of opposite faces, said annular body being attached on one of said faces thereof to said flat battery pack.

7. A sealed card-like flashlight device, comprising:

(a) an inner light generating module having a pair of opposite faces and means for generating light;

(b) a middle card insert extending over and substantially overlying said opposite faces of said inner light generating module; and (c) an outer protective cover having a periphery sealed about and hermetically encasing said middle insert and said inner light generating module and being sealed;

(d) said inner light generating module including a flat battery pack, a lamp having a light element and a pair of conductive lead elements extending therefrom, and means for electrically coupling said lead elements of said lamp to said flat battery pack;

(e) said coupling means including a first electrically conductive member overlying and electrically connecting one of said lead elements to a first electrically conductive portion of said flat battery pack, said coupling means also including a switch assembly attached to a second electrically conductive portion of said flat battery pack being spaced from said first electrically conductive portion thereof, said switch assembly being operable for making and breaking an electrical circuit between said flat battery pack and said lead elements of said lamp by applying and releasing pressure on and from a region of said outer protective cover overlying said switch assembly;

(f) said switch assembly including an electrically non-conductive switch pad attached about said second electrically conductive portion of said flat battery pack, said switch pad having an aperture defined therethrough encompassing said second electrically conductive portion of said flat battery pack, said switch assembly also including a second electrically conductive member overlying and electrically connected with the other of said lead elements and supporting said other lead element across said aperture of said switch pad and spaced from said second electrically conductive portion encompassed by said aperture;

(g) said first and second electrically conductive members being strips of electrically conductive metallic tape having an adhesive coating on one side thereof for adhering said strips of metallic tape respective to surfaces of said flat battery pack and said switch pad.

8. A sealed card-like flashlight device, comprising:

(a) an inner light generating module having a pair of opposite faces and means for generating light;

(b) a middle card insert extending over and substantially overlying said opposite faces of said inner light generating module; and (c) an outer protective cover having a periphery sealed about and hermetically encasing said middle insert and said inner light generating module and being sealed;

(d) said middle card insert including a flat sheet of material having a middle transverse fold line permitting the insert to be folded in half and a central opening defined through said flat sheet along said middle transverse fold line so as to define an opening aligned with said light generating means of said inner light generating module.

9. The device of claim 8 wherein an exterior face of said middle card insert is imprinted with a media displaying information to a user of the device.

10. The device of claim 8 wherein said middle insert card substantially covers said inner light generating module.

11. The device of claim 1 wherein said flat planar sheets of said outer protective cover are transparent.

12. A sealed card-like flashlight device, comprising:

(a) an inner light generating module having a pair of opposite faces and including a flat battery pack, a switch assembly, and a light emitting lamp;

(b) a middle card insert having a middle fold line providing said insert in a folded condition and extending over and substantially overlying said opposite faces of said inner light generating module, said insert having an opening defined therein along said middle fold line; and (c) an outer flat sleeve-like protective cover having a periphery sealed about and hermetically encasing said middle insert and said inner light generating module.

13. The device of claim 12 wherein said lamp has a light element and a pair of conductive lead elements extending therefrom.

14. The device of claim 13 wherein:

said inner module also includes a first electrically conductive member overlying and electrically connecting one of said lead elements to a first electrically conductive portion of said flat battery pack; and a switch assembly is attached to a second electrically conductive portion of said flat battery pack being spaced from said first electrically conductive portion thereof, said switch assembly being operable for making and breaking an electrical circuit between said flat battery pack and said lead elements of said lamp by applying and releasing pressure on and from a region of said outer protective cover overlying said switch assembly.

15. The device of claim 14 wherein said switch assembly includes:

an electrically non-conductive switch pad attached about said second electrically conductive portion of said flat battery pack, said switch pad having an aperture defined therethrough encompassing said second electrically conductive portion of said flat battery pack; and a second electrically conductive member overlying and electrically connected with the other of said lead elements and supporting said other lead element across said aperture of said switch pad and spaced from said second electrically conductive portion encompassed by said aperture.

16. The device of claim 15 wherein said switch pad is a thin annular body of electrically non-conductive material defining said central aperture and having a pair of opposite faces, said annular body being attached on one of said faces thereof to said flat battery pack.

17. The device of claim 15 wherein said first and second electrically conductive members are strips of electrically conductive metallic tape having an adhesive coating on one side thereof for adhering said strips of metallic tape respective to surfaces of said flat battery pack and said switch pad.

18. The device of claim 12 wherein an exterior face of said middle card insert is imprinted with a media displaying information to a user of the device.

19. The device of claim 12 wherein said middle insert card substantially covers said inner light generating module.

20. The device of claim 12 wherein said outer protective cover is a pair of flat sheets of transparent plastic material being sealed to one another about continuous peripheral regions thereof.

* * * * *